US010273838B2

(12) United States Patent
Ikemi et al.

(10) Patent No.: US 10,273,838 B2
(45) Date of Patent: Apr. 30, 2019

(54) VALVE SEAT INSERT FOR INTERNAL COMBUSTION ENGINE HAVING EXCELLENT WEAR RESISTANCE

(71) Applicants: NIPPON PISTON RING CO., LTD., Saitama (JP); HONDA MOTOR CO., LTD., Tokyo (JP); SANYO SPECIAL STEEL CO., LTD., Hyogo (JP)

(72) Inventors: Satoshi Ikemi, Tochigi (JP); Hiroshi Oshige, Tochigi (JP); Seisuke Takaki, Tochigi (JP); Tomoki Okita, Saitama (JP); Keisuke Ishii, Saitama (JP); Toshiyuki Sawada, Hyogo (JP); Hiroyuki Hasegawa, Hyogo (JP)

(73) Assignees: NIPPON PISTON RING CO., LTD., Saitama (JP); HONDA MOTOR CO., LTD., Tokyo (JP); SANYO SPECIAL STEEL CO., LTD., Hyogo (JP)

( * ) Notice: Subject to any disclaimer, the term of this patent is extended or adjusted under 35 U.S.C. 154(b) by 286 days.

(21) Appl. No.: 15/386,554

(22) Filed: Dec. 21, 2016

(65) Prior Publication Data

US 2017/0175596 A1 Jun. 22, 2017

(30) Foreign Application Priority Data

Dec. 22, 2015 (JP) ..... 2015-249829

(51) Int. Cl.
*F01L 3/02* (2006.01)

(52) U.S. Cl.
CPC ..... *F01L 3/02* (2013.01)

(58) Field of Classification Search
CPC ..... F01L 3/02; F01L 3/04
See application file for complete search history.

(56) References Cited

U.S. PATENT DOCUMENTS

| | | | | |
|---|---|---|---|---|
| 6,082,317 | A | 7/2000 | Takahashi | |
| 9,581,056 | B2 | 2/2017 | Koyama | |
| 2003/0177863 | A1* | 9/2003 | Koyama | C22C 33/0228 75/241 |

(Continued)

FOREIGN PATENT DOCUMENTS

| | | |
|---|---|---|
| JP | H08-134608 | 5/1996 |
| JP | 2009242516 A | 9/1997 |
| JP | 2706561 B2 | 1/1998 |

(Continued)

*Primary Examiner* — Jacob Amick
(74) *Attorney, Agent, or Firm* — Young & Thompson

(57) ABSTRACT

Provided is a valve seat insert made of an iron-base sintered alloy, in which a base matrix part that includes a base matrix phase and hard particles, has a base matrix part composition containing, in % by mass, 0.5%-2.0% of carbon and 10%-70% in total of one kind or two or more kinds selected from nickel, cobalt, chromium, molybdenum, vanadium, tungsten, manganese, silicon and sulfur, with the balance being iron and unavoidable impurities, and Co-base hard particles having a composition containing, 1.0% or less of C, 25%-50% of Mo, 5%-15% of Cr, Si as an impurity in a content adjusted to be 0.3% or less, with the balance being Co, and having a Vickers hardness of 500 to 1,500 HV, are dispersed as hard particles in the base matrix phase in an amount of 10%-60% by mass with respect to the total amount of the valve seat insert.

14 Claims, 4 Drawing Sheets

(56) References Cited

U.S. PATENT DOCUMENTS

2005/0193861 A1* 9/2005 Sato ..... C22C 1/02
75/246

FOREIGN PATENT DOCUMENTS

| | | | |
|---|---|---|---|
| JP | H-1112697 | A | 1/1999 |
| JP | 2002-129296 | | 5/2002 |
| JP | 2002285293 | A | 10/2002 |
| JP | 2006299404 | A | 11/2006 |
| JP | 2011-157845 | | 8/2011 |
| JP | 2013113220 | A | 6/2013 |

* cited by examiner

VALVE SEAT INSERT FOR INTERNAL COMBUSTION ENGINE HAVING EXCELLENT WEAR RESISTANCE

BACKGROUND

Technical Field

The present invention relates to a valve seat insert for an internal combustion engine, and more particularly, to a valve seat insert which has excellent wear resistance and is particularly suitable for use in a high-load internal combustion engine that uses an alcohol fuel or a fuel gas.

Related art

In internal combustion engines (automotive engines) using liquid fuels such as gasoline and light oil, since lubricity between a valve and a valve seat insert is maintained to a certain extent by means of fuel or combustion products, wear of a valve seat insert is suppressed to a certain extent. However, in an engine that uses a fuel gas such as liquid petroleum gas (LPG) or compressed natural gas (CNG), or an alcohol fuel, a reduced amount of combustion products is produced, and metal-to-metal contact is likely to occur between a valve and a valve seat insert, so that wear of a valve seat insert tends to increase. Therefore, there has been a demand for a further enhancement in the wear resistance of valve seat inserts.

In regard to such a demand, for example, JP 09-242516 A describes a valve seat insert for an internal combustion engine, in which cobalt-base hard particles are dispersed in a base matrix of an iron-base alloy. It is suggested that in the valve seat insert described in JP 09-242516 A, cobalt-base hard particles is to be incorporated in an amount Of 26% to 50% into a base matrix containing, in percent (%) by weight, carbon (C) at a content of 0.5% to 1.5% and at least one element selected from the group consisting of nickel (Ni), cobalt (Co) and molybdenum (Mo) at a total content of 2.0% to 20.0%, with the balance being iron (Fe). It is disclosed that this valve seat insert is suitable for use in an internal combustion engine, such as a fuel gas engine as a representative example, in which wear caused by metal-to-metal contact is likely to occur. JP 09-242516 A describes trade name: "TRIBALLOY T-400" and trade name: "TRIBALLOY T-800" as examples of the cobalt-base hard particles to be used for the invention.

Furthermore, JP 11-12697 A describes a valve seat insert for an internal combustion engine, which contains, as base matrix components, at least carbon (C) at a content of 0.5% to 1.5% by weight and chromium (Cr) and/or vanadium (V) at a total content of 0.5% to 10.0% by weight, or even at least one element selected from the group consisting of Ni, Co and Mo at a total content of 2.0% to 20.0% by weight, with the balance being Fe, and also contains cobalt-base hard particles in an amount of 26% to 50% by weight. It is suggested that the valve seat insert for an internal combustion engine described in JP 11-12697 A can be suitably used even under harsh use conditions, as in the case of the internal combustion engine represented by a fuel gas engine. JP 11-12697 A describes hard particles having a composition containing, in percentage (%) by mass, 0.08% or less of C, 28.5% of Mo, 17.5% or Cr, and 3.4% of silicon (Si), with the balance being Co (trade name "TRIBALLOY T-800") as preferred cobalt-base hard particles.

JP 2706561 B describes a valve seat insert material for an internal combustion engine, characterized in that the total composition has a composition containing, by weight ratio, 0.3% to 1.5% of C, 0.1% to 0.8% of Si, 1.4% to 4% of Cr, 0.1% to 2% of Ni, 2.7% to 13% of Mo, 0.2% to 9.5% of tungsten (W), 11% to 20% of Co, and 0.1% to 2.6% of V, with the balance being Fe, and that the structure has such that 20% to 50% of a high-speed tool steel phase in which metallic carbides are dispersed, 10% to 20% of a cobalt alloy hard phase in which intermetallic compounds are dispersed, an iron alloy phase containing Co—Ni—Mo—C, and an intermediate phase in which the cobalt alloy hard phase is dispersed into other phases, are mixed in a spotted manner. According to the technology described in JP 11-12697 A, high temperature wear resistance of the valve seat insert material is enhanced, and abrasive wear or fatigue fracture wear does not easily occur. Thus, enhancement of the performance of engines can be promoted. In JP 2706561 B, it is described that it is preferable to use a cobalt alloy powder having a composition containing, by weight ratio, 1.5% to 2.5 of Si, 7% to 9% of Cr, and 26% to 30% of Mo, with the balance being Co, for the use as hard particles.

Furthermore, JP 2002-285293 A describes a valve seat insert material for a high-load engine, in which the overall composition contains, by weight ratio, 12.5% to 35.3% or Co, 5.4% to 16.2% of Mo, 1.7% to 6% of Cr, 0.02% to 0.24% of V, 0.4% to 1.5% of Si, 0.01% to 13.5% of Ni, and 0.6% to 1.2% or C, with the balance being Fe and unavoidable impurities, and the valve seat insert material has a metallic structure in which a hard phase mainly containing molybdenum silicides as nuclei and being surrounded by a diffusion layer formed by Co diffused in the peripheries of the nuclei, are dispersed in bainite or in a mixed structure of bainite, sorbite, martensite and austenite. According to the technology described in JP 2002-285293 A, since the valve seat insert material exhibits excellent wear resistance, the valve seat insert material is considered promising as a valve seat insert material for a high-load engine such as a CNG engine. According to the technology described in JP 2002-285293 A, since wear resistance is imparted by dispersing a hard phase mainly containing molybdenum silicides as nuclei, it is suggested to add a Co-base alloy powder. Regarding the Co-base alloy powder, a powder containing 26% to 30% of Mo, 7% to 9% of Cr, and 2% to 3% of Si, with the balance being Co and unavoidable impurities, is mentioned as an example. It is suggested that Si in this powder is bonded to Mo and Co and forms hard molybdenum silicides and Mo—Co silicides, and thereby contributes to enhancement of wear resistance.

However, in recent: years, further performance enhancement of engines for fuel gas and the: like is pursued, and accordingly the use environment of valve seat inserts has become harsher. Thus, there is a demand for further enhancement of the wear resistance of valve seat inserts used therein. In regard to such a demand, the technologies described in JP 09-242516 A, JP 11-12697 A, JP 2706561 B, and JP 2002-285293 A have a problem that sufficiently satisfactory characteristics cannot be secured.

In connection with such a problem, for example, JP 2006-299404 A describes a valve seat insert material made of an iron-base sintered alloy for an internal combustion engine, in which hard particles containing one or two or more of an intermetallic compound containing Fe, Mo and Si as main components, an intermetallic compound containing Co, Mo and Si as main components, and an intermetallic compound containing Ni, Mo and Si as main components, and having a Vickers hardness of 500 HV0.1 to 1200 HV0.1, are dispersed in an amount of 10% to 60% by mass in a base matrix phase having a composition concerning, in percentage (%) by mass, 0.3% to 1.5% of C, and 1% to 20% in total of one or two or more selected from among Ni, Co, Mo, Cr and V, or further including one or two selected from among Cr and V; and the valve seat, insert material has a density of 6.7 g/cm$^3$ or higher and a radial crushing strength of 350 MPa or higher. According to the technology described in JP 2006-299404 A, a large amount of hard particles having low opposite aggressibility can be stably dispersed, and even in a harsh use environment such as in a fuel gas engine, high strength and excellent wear resistance can be secured for a long time period.

Furthermore, JP 2013-113220 A describes a valve seat insert using an iron-base sintered alloy. The valve seat insert described in JP 2013-113220 A contains an iron base sintered alloy in which, before the iron-base sintered alloy to be used is mounted in a cylinder head, hard particles formed from at least one compound of intermetallic compounds, carbides, silicides, nitrides and borides of one or more elements selected from the elements of Groups 4a to 6a of the Periodic Table and having a hardness of 600 to 1600 HV, are included at an average area ratio of 5% to 45% in a cross-section, and an oxide containing tri-iron tetroxide as a main component is formed at the surface and in the interior by an oxidation treatment at an average area ratio in a cross-section of 5% to 20%. Thereby, a valve seat insert having excellent strength and wear resistance is obtained, and this is particularly suitable as a valve seat insert for a diesel engine, a LPG engine, a CNG engine or the like. Meanwhile, JP 2013-113220 A suggests that intermetallic compounds such as Fe—Mo, Fe—Cr and Co—Mo—Cr; and Fe-base alloys, Co-base alloys or Ni-base alloys, in which carbides of Cr, Mo and the like, are preferable as the hard particles formed from at least one compound selected from intermetallic compounds, carbides, silicides, nitrides and borides of one or more elements selected from the elements of Groups 4a to 6a of the Periodic Table and having a hardness of 600 to 1600 HV. However, there is no mention about the specific composition of the hard particles in JP 2013-113220 A.

SUMMARY

However, engines for fuel gas and the like that have been developed in recent years are required to have further enhanced engine performance, and accordingly, the use environment for valve seat inserts has also become harsher. Therefore, there is a strong demand for further enhancement of wear resistance for valve seat inserts. For this reason, there is a problem that even with the technologies described in JP 2006-299404 A and JP 2013-113220, the demand cannot be sufficiently satisfied.

An object of the present invention is to solve such problems of the prior art technologies, and to provide a valve seat insert having excellent wear resistance, which is suitable exclusively for engines for fuel gas and the like.

In order to achieve the object described above, the inventors of the present invention conducted an investigation on various factors affecting the wear resistance of a valve seat insert. As a result, the inventors found that the composition of the hard particles that are dispersed in a base matrix significantly effects the wear resistance of a valve seat insert.

It has been hitherto considered that Cr—Mo—Si-type Co-base hard particles forms a Laves phase $Co_3Mo_2Si$ by incorporating Si in addition to Co, Cr and Mo, and thereby contributes to enhancement of wear resistance. Therefore, it has been believed that Si plays an important role in the formation of the Laves phase $Co_3Mo_2Si$, and a predetermined amount of Si is incorporated as an essential component into the Cr—Mo—Si-type Co-base hard particles. However, according to the study of the present inventors, the inventors found that a Laves phase is certainly formed in the Cr—Mo—Si-type Co-base hard particle powder, while the Laves phase disappears in a sintered body (valve seat insert), so that a carbide $Co_3Mo_3C$ is formed.

Thus, the present inventors contemplated to use Cr—Mo-type Co-base hard particles that are free of Si, as the hard particles to be dispersed in the base matrix phase of a valve seat insert.

First, a basic experiment that was conducted by the present inventors will be explained.

A valve seat insert (size: outer diameter 30 mmϕ×inner diameter 18 mmϕ×thickness 6.5 mm) in which hard particles were dispersed in a base matrix phase was prepared. The valve seat insert thus prepared was a valve seat insert in which the base matrix part including a base matrix phase and hard particles had a base matrix part composition containing, in percentage (%) by mass, 0.8% to 1.2% of C and further 13% to 15% of Co, 5% to 7% of Mo, 1.0% to 1.5% of manganese (Mn), and 0.5% to 1.0% of sulfur (S), with me balance being Fe and unavoidable impurities, and the hard particles were dispersed in the base matrix phase at an amount of 18% to 22% by mass with respect to the total amount of the valve seat insert. The hard particles used therein included particles having a composition containing, in percentage (%) by mass, 8.5% of Cr, 28.5% of Mo, and 2.6% of Si, with the balance being Co and unavoidable impurities (hard particles A), or particles having a composition containing, in percentage (%) by mass, 9% of Cr and 31% of Mo, with the balance being Co and unavoidable impurities (hard particles B). Meanwhile, the hard particles B (Si-less particles) were particles in which Si was not added, and the content of Si was adjusted to be less than 0.3% by mass as an impurity. The valve seat insert used for the experiment was a valve seat insert having a predetermined dimension and a predetermined shape, obtained by proportionally mixing a powder for forming a base matrix phase in an amount that would give the base matrix part composition described above, with hard particles in an amount chat would give the amount of dispersion described above, mixing and kneading the mixture to obtain a mixed powder, and subjecting the mixed powder to a 1P1S process including compacting and sintering. The valve seat insert obtained by using the hard particles A had a density of 6.9 g/cm$^3$, a hardness of 750 HV, and a radial crushing strength of 650 MPa. Furthermore, the valve seat insert obtained by using the hard particles B had a density of 7.0 g/cm$^3$, a hardness of 710 HV, and a radial crushing strength of 651 MPa.

The two kinds of valve seat inserts in which such hard particles were dispersed were subjected to a single piece rig wear test using a single piece rig wear testing machine as shown in FIG. 4. A valve seat insert 1 was press fitted into a cylinder head-equivalent jig 2, and while a valve 4 and the valve seat insert 1 were heated by a heat source (LPG+air) 3 installed in the testing machine, the valve 4 was moved vertically by a crank mechanism. Thus, the amount of wear was measured based on the amount of valve sinking. The test conditions were as follows.

Testing temperature: 250° C.
Testing time: 4.5 hr
Frequency of cam rotation: 3000 rpm
Frequency of valve rotation: 20 rpm.
Spring load: 2940 N (upon setting)
Valve material: T-400 padded
Amount of lift: 8.5 mm The results thus obtained are shown in FIG. 1.

It can be seen from FIG. 1 that when particles that do not contain Si (hard particles B) are used as the hard particles, the amount of wear of the valve seat insert is reduced compared to the case in which hard particles containing Si (hard particles A) are used as the hard particles. Meanwhile, FIG. 1 is indicated as a ratio of wear with respect to the amount of wear in the case of using the hard particles A as a reference (100).

Next, for the valve seat insert after the wear test, characteristics of the valve seat insert working face (wear surface) were observed using an electron probe microanalyzer (EPMA). The results are shown in FIG. 2. FIG. 2(*a*) is a secondary-electron images and FIG. 2(*b*) presents the distribution of oxygen (O) in the region shown in FIG. 2(*a*).

It can be seen from FIG. 2(*b*) that in a valve seat insert employing particles that do not contain Si (hard particles B) as the hard particles, a large amount of oxygen (O) is distributed in the valve seat insert working face, compared to the case in which the hard particles contain Si (hard particles A). From this point of view, the inventors speculated that when a large amount of oxygen (O), that is, oxides, is distributed in the valve seat insert working face (wear surface), wear resistance is enhanced.

Thus, next, a valve seat insert having such hard particles dispersed therein was subjected to an oxidation test of charging the valve seat insert into a heating furnace in an air atmosphere, which had been heated to a furnace temperature of 400° C., and holding the valve seat insert for a predetermined time up to 10 hours in the heating furnace, and the oxidation increment was measured. The oxidation increment was evaluated by the proportion (%) with respect to the weight before the oxidation test. The results thus obtained are shown in FIG. 3.

It can be seen from FIG. 3 that when particles that do not contain Si (hard particles B) are employed as the hard particles, the increase ratio of the oxidized weight of the valve seat insert becomes higher compared to the case in which the hard particles contain Si (hard particles A). That is, it is speculated that when particles that do not contain Si are employed as the hard particles, it becomes easy to adsorb oxygen.

From this viewpoint, the inventors of the present invention suspected that a valve seat insert in which particles that do not contain Si are dispersed are used as the hard particles, can easily absorb oxygen during sliding (use), has a large amount of oxides distributed at the valve seat insert working face (wear surface), and has enhanced wear resistance. Meanwhile, according to the investigation of the inventors, it was found that in a case in which two or more kinds of hard particles are mixed and dispersed, when at least one kind of the hard particles is constituted by hard particles that do not contain Si, wear resistance is enhanced compared to the case in which only those hard particles containing Si are dispersed.

The present invention was achieved based on the findings described above, with further investigations having been conducted therefor. That is, the gist of the invention is as follows.

(1) There is provided a valve seat insert for an internal combustion engine having excellent wear resistance, the valve seat insert being made of an iron-base sintered alloy in which hard particles are dispersed in a base matrix phase of an iron-base sintered alloy, wherein a base matrix part that includes the base matrix phase and the hard particles has a composition containing, in percentage (%) by mass, 0.5% to 2.0% of carbon (C) and 10% to 70% in total of one kind or two or more kinds selected from nickel (Ni), cobalt (Co), chromium (Cr), molybdenum (Mo), vanadium (V), tungsten (W), manganese (Mn), silicon (Si) and sulfur (S), with the balance being iron (Fe) and unavoidable impurities, the valve seat insert has a structure in which, as the hard particles, Co-base hard particles having a composition containing, in percentage (%) by mass, 1.0% or less of C, 25% to 50% of Mo, 5% to 15% of Cr, Si as an impurity in a content adjusted to be 0.3% or less, with the balance being Co, and having a Vickers hardness of 500 to 1,500 HV, are dispersed in an amount of 10% to 60% by mass with respect to the total amount of the valve seat insert, and the valve seat Insert has a density of 6.5 g/cm$^3$ or higher and a radial crushing strength of 450 MPa or higher.

(2) In the valve seat insert according to (1), the hard particles are replaced with two or more kinds of hard particles, one kind of the hard particles are Co-base hard particles having a composition containing, in percentage (%) by mass, 1.0% or less or C, 25% to 30% of Mo, 5% to 15% of Cr, and Si as an impurity in a content adjusted to be 0.3% or less, with the balance being Co, and having a Vickers hardness of 500 to 1,500 HV, the amount of the Co-base hard particles is 10% or more by area with respect to the total amount of the hard particles, and the two or more kinds of hard particles are dispersed in an amount of 10% to 60% by mass with respect to the total amount of the valve seat insert.

(3) In the valve seat insert according to (1) or (2), the Co-base hard particles have a composition further containing, in percentage (%) by mass, one kind or two or more kinds selected from 35% or less of Mn, 20% or less of V, and 15% or less of Fe, in addition to the composition described above.

(4) In the valve seat insert according to any one of (1) to (3), solid lubricant particles are further dispersed in the base matrix phase in an amount of 0.5% to 3.0% by mass with respect to the total amount of the valve seat insert, in addition to the hard particles.

(5) There is provided a valve seat insert for an internal, combustion engine having excellent wear resistance, the valve seat insert being made of an iron-base sintered alloy and having a double-layer structure in which a valve contacting face side and a supporting face side are integrally sintered, wherein the valve contacting face side is formed by dispersing hard particles in a base matrix phase of an iron-base sintered alloy, a base matrix part that Includes the base matrix phase and the hard particles has a composition containing, in percentage (%) by mass, 0.5% to 2.0% of carbon (C) and 10% to 70% in total of one kind or two or more kinds selected: from nickel (Ni), cobalt (Co), chromium (Cr), molybdenum (Mo), vanadium (V), tungsten (W), manganese (Mn), silicon (Si) and sulfur (S), with the balance being iron (Fe) and unavoidable impurities, the valve seat insert has a structure in which, as the hard particles, Co-base hard particles having a composition containing, in percentage (%) by mass, 1.0% or less of C, 25% to 50% of Mo, 5% to 15% of Cr, Si as an impurity in an amount adjusted to be 0.3% or less, with the balance being Co, and having a Vickers hardness of 500 to 1,500 HV, are dispersed in an amount of 10% to 60% by mass with respect to the total amount of the valve contacting face side, and the supporting face side has a composition containing, in percentage (%) by mass with respect to the total amount of the supporting face side, 0.5% to 2.0% of C, or 70% or less in total of one kind or two or more kinds selected from Ni, Cr, Mo and copper (Cu), with the balance being Fe and unavoidable impurities.

(6) In the valve seat insert according to (5 ), the hard particles are replaced with two or more kinds of hard particles, one kind of the hard particles are Co-base hard particles having a composition containing, in percentage (%) by mass, 1.0% or less of C, 25% to 50% of Mo, 5% to 15% of Cr, and Si as an ire-parity in a content adjusted to be 0.3% or less, with the balance being Co, and having a Vickers hardness of 500 to 1,500 HV, the amount of the Co-base hard particles is 10% or more by area with respect to the total amount of the hard particles, and the two or more kinds of hard particles are dispersed in an amount of 10% to 60% by mass with respect to the total amount of the valve contacting face side.

(7) In the valve seat insert according to (5) or (6), the Co-base hard particles have a composition further containing, in percentage (%) by mass, one kind or two or more kinds selected from 35% or less of Mn, 20% or less of V, and 15% or less of Fe, in addition to the composition described above.

(8) In the valve seat insert according to any one of (5) to (7), solid lubricant particles are further dispersed in the base matrix phase in an amount of 0.5% to 3.0% by mass with respect to the total amount of the valve contacting face side, in addition to the hard particles.

According to the invention, a valve seat insert having excellent wear resistance, which can be used even in a harsh environment in which wear caused by metal-to-metal contact is likely to occur, such as an engine for fuel gas or the like, can be easily produced, and thus special effects in an industrial viewpoint are provided.

DETAILED DESCRIPTION

Figure 1:
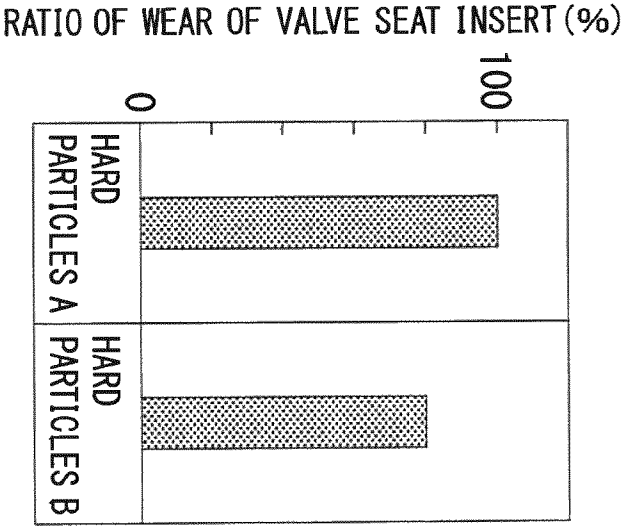
FIG. 1 is a graph showing a comparison of the amounts of wear of valve seat inserts in a single piece rig wear test.
Figure 2:
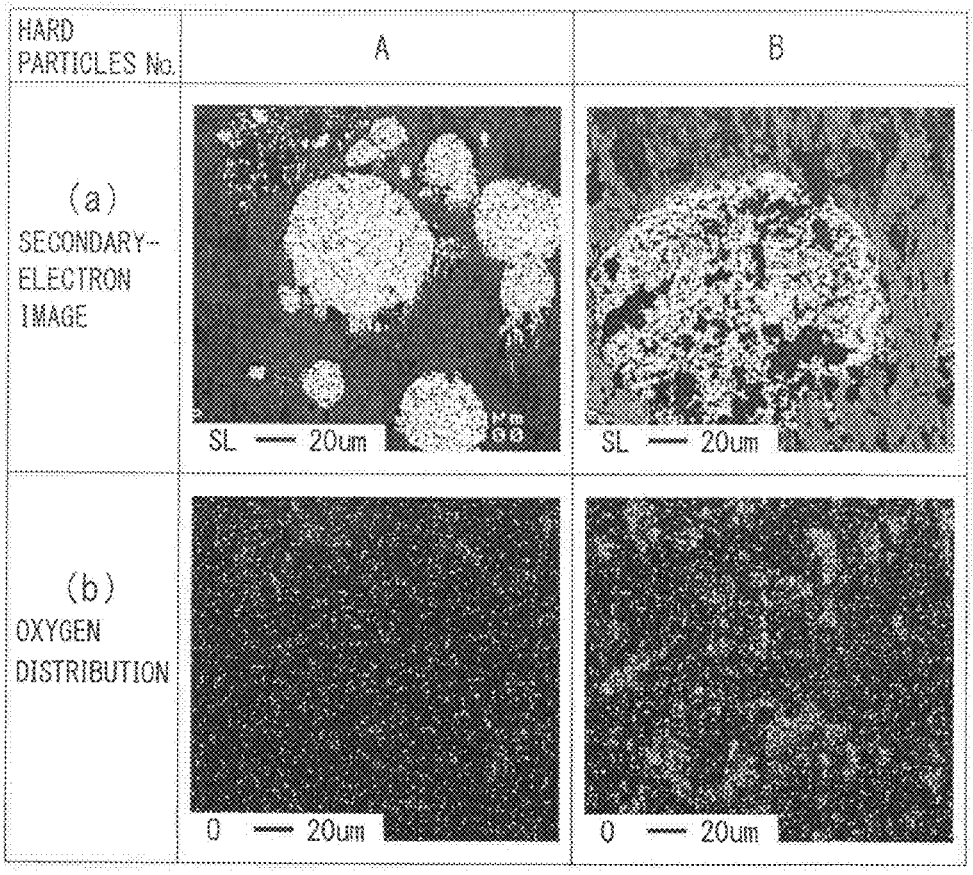
FIG. 2 is a set of explanatory diagrams showing secondary-electron images (a) and oxygen distribution conditions (b) of valve seat insert wear surfaces determined by EPMA.
Figure 3:
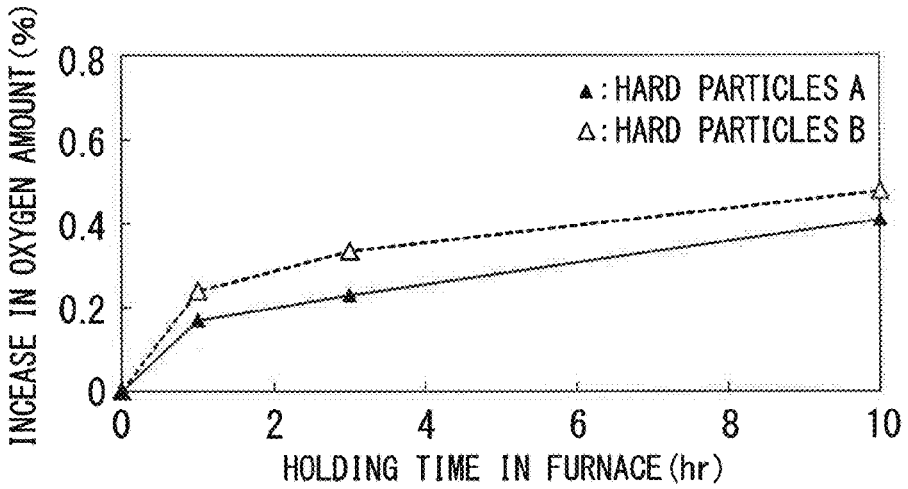
FIG. 3 is a graph snowing the relation between the holding time in the furnace and the increase in oxygen amount in an oxidation test.

The valve seat insert for an internal combustion engine of the invention is a valve seat insert made of an iron-base sintered alloy, in which hard particles are dispersed in a base matrix phase of an iron-base sintered alloy. It is preferable that the valve seat insert for an internal combustion engine of the invention has a single-layer structure, or a double-layer structure composed of a valve contacting face side and a supporting face side.

The valve seat insert made of an iron-base sintered alloy of the invention has a base matrix part composition such that in a single layer or at the valve contacting face side in a double-layer structure, the base matrix part that includes a base matrix phase and hard particles contains 0.5% to 2.0% of C, and 10% to 70% in total of one kind or two or more kinds selected from Ni, Co, Cr, Mo, V, W, Mn, Si, and S, in percentage (%) by mass with respect to the total mass of the total amount of the valve seat insert in the case of a single layer, or with respect to the total amount of the valve contacting face side in the case of a double-layer structure, with the balance being Fe and unavoidable impurities.

First, the reason for such limitation of the base matrix part composition will be explained. Meanwhile, the unit "percent (%) by mass" in the composition will be described simply as "percent (%)" below.

C: 0.5% to 2.0%

C is an element that is added to the composition in order to accelerate diffusion at the time of sintering, but is solid-solubilized in the base matrix, thereby increasing the strength of the base matrix phase. In order to obtain such an effect, it is necessary that C is contained at a content of 0.5% or more. On the other hand, if C is contained at a content of more than 2.0%, cementite is likely to he generated in the base matrix, and also, a liquid phase is likely to be generated at the time of sintering. Thus, stability of the structure is deteriorated, and manufactured products have large dimensional changes. For this reason, the content of C in the base matrix phase is limited to a range of 0.5% to 2.0%.

One or two or more selected from Ni, Co, Cr, Mo, V, W, Mn, Si and S: 10% to 70% in total Ni, Co, Cr, Mo, V, W, Mn, Si and S are all elements that contribute to an increase in strength of the base matrix phase and enhance the wear resistance of the base matrix, and one kind or two or more kinds thereof are selected and contained. In order to obtain such an effect, it is necessary that these elements are contained at a content of 10% or more in total. On the other hand, if these elements are contained at a content of more than 70% in total, the bonding strength between particles is decreased, and the radial crushing strength is decreased. Therefore, the content of the one kind or two or more kinds selected from Ni, Co, Cr, Mo, V, W, Mn, Si and S is limited to be 10% to 70% in total. The content, is preferably 20% to 50% in total.

The balance of the composition excluding the above-mentioned components in the base matrix part is composed of Fe and unavoidable impurities.

The valve seat insert according to the invention is a valve seat insert in which hard particles axe dispersed in a base matrix phase so as to obtain the base matrix part composition described above in a single layer, or at the valve contacting face side in a double-layer structure. According to the invention, in a case in which one kind of hard particles is employed as the hard particles to be dispersed in the base matrix phase, Co-base hard particles are used. Specifically, Co-base hard particles having a composition that contains, in percentage (%) by mass, 1.0% or less of C, 25% to 50% of Mo, and 5% to 15% of Cr with respect to the total amount of hard particles, in which the content of Si as an impurity has been adjusted to 0.3% or less, and the balance is Co, and having a Vickers hardness of 500 to 1,500 HV, are used as the hard particles.

Two or more kinds of hard particles may also be used. In that case, at least one kind of the hard particles is constituted by Co-base hard particles having a composition in which the content of Si as an impurity has been adjusted to 0.3% or less. The amount of the Co-base hard particles having a composition such as described above is adjusted to be 10% or more m the area ratio with respect to the total amount of hard particles. If the amount of Co-base hard particles having such a composition as described above is less than 10%, the desired enhancement of wear resistance cannot be expected.

In the Co-base hard particles that are to be dispersed as hard particles in the base matrix phase according to the invention, the content of Si is adjusted to be 0.3% or less, which is regarded as an impurity level. If the Si content becomes higher than 0.3%, the increase in oxygen amount is reduced during a use as a valve seat insert, and the extent of the enhancement of wear resistance becomes small. When the content of Si in the hard particles is adjusted to be 0.3% or less, the increase in oxygen amount is increased during a use as a valve seat insert, wear resistance is further enhanced. Also, when the content of Si is adjusted to be 0.3% or less, the hard particles have low hardness being in a powder state and have increased compacting properties and oxidation characteristics. Therefore, the content of Si in the hard particles should be adjusted to 0.3% or less.

In the Co-base hard particles to be used for the invention, in which the Si content is adjusted to a low level, the particle composition contains 1.0% or less of C, 25% to 50% of Mo, and 5% to 15% of Cr, with the balance being Co and unavoidable impurities. When the composition described above is used, hardened particles in which a compound composed of Mo, Co and C (intermetallic compound) has been formed are obtained. When a composition that is not contained in this range is adopted, the above-mentioned compound (intermetallic compound) is not easily formed, desired particle hardness cannot be secured, and wear resistance is decreased.

Furthermore, in the Co-base hard particles to be used for the invention, in which the Si content is adjusted to a low level, it is preferable that the composition further contains one kind or two or more kinds selected from 35% or less of Mn, 20% or less of V, and 15% or less of Fe, in addition to the composition described above.

Mn, V and Fe are all elements that contribute to an enhancement of wear resistance of the valve seat insert without lowering the hardness of the Co-base hard particles, and these elements are contained as necessary. In order to obtain such an effect, Mn needs to be contained at a content of 35% or less, V at a content of 20% or less, and Fe at a content of 15% or less. On the other hand, if these elements are contained at contents exceeding Mn: 35%, V: 20%, and Fe: 15%, respectively, the bonding strength between particles is decreased. Therefore, if these elements are to be contained, it is preferable that the contents are limited to Mn: 35% or less, V; 20% or less, and Fe: 15% or less, respectively.

In the Co-base hard particles to be used for the invention, in which the Si content is adjusted to a low level, the balance of the composition excluding the above-mentioned components is composed of Co and unavoidable impurities.

The hard particles having the above-described composition are hard particles having a Vickers hardness of 500 to 1,500 RV. If the hardness of the hard particles is below 500 HV, desired wear resistance can be secured, and if the hardness is above 1,500 HV, opposite aggressibility is increased. Therefore, the hardness of the hard particles is limited to a Vickers hardness in the range of 500 to 1,500 HV.

According to the invention, in the case of a single-layer structure, hard particles having the above-described composition and the above-described hardness are dispersed in a base matrix phase at an amount of 10% to 60% by mass with respect to the total amount of the valve seat insert. In the case of a double-layer structure, it is preferable that the hard particles are dispersed in the valve contacting face side at an amount of 10% to 60% by mass with respect to the total amount of the valve contacting face side.

If the amount of the hard particles is less than 10%, intended wear resistance cannot be secured. On the other hand, if the hard particles are dispersed in a large amount that exceeds 60%, this causes an increase in the material cost, it becomes economically disadvantageous, and moldability is decreased. Also, opposite aggressibility is increased, and also, the radial crushing strength is decreased. For this reason, in this invention, in the case of a single-layer structure, the hard particles should be dispersed in an amount in the range of 10% to 60% by mass with respect to the total amount of the valve seat insert. In the case of a double-layer structure, it is preferable that the hard particles are dispersed in the valve contacting face side at an amount of 10% to 60% by mass with respect to the total amount of the valve contacting face side. However, there is still no problem even if the hard particles are also dispersed in the supporting face side to the same extent.

In the valve seat insert of the invention, solid lubricant particles may also be dispersed in the base matrix phase, in addition to the above-described hard particles, at an amount of 0.5% to 3.0% by mass with respect to the total amount of the valve seat insert in the case of a single-layer structure, and at an amount of 0.5% to 3.0% by mass with respect to the total amount of the valve contacting face side in the case of a double-layer structure. When solid lubricant particles are dispersed in the base matrix phase, machinability and wear resistance are enhanced. In order to obtain such effects, it is preferable that the solid lubricant particles are dispersed at an amount of 0.5% or more. On the other hand, if the solid lubricant particles are dispersed at an amount of more than 3.0%, the radial crushing strength is decreased. From this point of view, in a case in which the solid lubricant particles are dispersed, the solid lubricant particles should be dispersed at an amount of 0.5% to 3.0% by mass with respect to the total amount of the valve seat insert in the case of a single-layer structure, and at an amount of 0.5% to 3.0% by mass with respect to the total amount of the valve contacting face side in the case or a double-layer structure. The amount of the solid lubricant particles is more preferably 1.5% to 2.5%.

Examples of the solid lubricant particles include sulfides such as MnS and $Mo_2S$; fluorides such as $CaF_2$; and oxides such as $MgSiO_2$.

In a case in which the valve seat insert is constructed as a double-layer structure composed of a valve contacting face side and a supporting face side, the valve contacting face side is constructed as a layer having the base matrix part composition described above and having a structure in which the hard particles are dispersed in the base matrix phase. On the other hand, the supporting face side is formed by being integrally sintered together with the valve contacting face side.

In the supporting face side, the base matrix phase has a composition containing C at a content of 0.5% to 2.0% by mass, or one kind or two or more kinds selected front Ni, Cr, Mo and Co at a content of 70% or less in total, with respect to the total amount of the supporting face side, with the balance being Fe and unavoidable impurities.

C: 0.5% to 2.0%

C is an element that is added to the composition in order to accelerate diffusion at the time of strength sintering of the base matrix phase, but is solid-solubilized in the base matrix, thereby increasing the strength of the base matrix phase. In order to obtain such an effect, it is necessary chat C is contained at a content of 0.5% or more. On the other hand, if C is contained at a content of more than 2.0, cementite is likely to be generated in the base matrix, and also, a liquid phase is likely to be generated at the time of sintering. Thus, stability of the structure is deteriorated, and manufactured products nave large dimensional changes. For this reason, the content of C in the base matrix phase of the supporting face side is limited to a range of 0.5% to 2.0%.

One or two or more selected from Ni, Cr, Mo and Cu: 70% or less in total

Ni, Cr, Mo and Cu are all elements that contribute to an increase in strength of the base matrix phase, and one kind or two or more kinds thereof can be selected and contained as necessary, in accordance with the desired strength of the supporting face side. in order to obtain such an effect, it is necessary that one kind or two or more kinds selected from Ni, Cr, Mo and Cu are contained at a content of 3% or more in total. On the other hand, if these elements are contained in excess at a content of more than 70% in total, the bonding strength between particles is decreased, and the radial crushing strength is decreased. Therefore, if these elements are to be contained, it is preferable that the content of the one kind or two or more kinds selected from Ni, Cr, Mo and Cu is limited to be 70% or less in total. The content is more preferably 5% to 15%.

In the supporting face side, the balance of the composition excluding the above-mentioned components is composed of Fe and unavoidable impurities.

Furthermore, the valve seat insert of the invention has a density of 6.5 g/cm$^3$ or higher and a radial crushing strength of 450 MPa or higher. The "radial crushing strength" as used herein is defined as a value measured according to the procedure of JIS Z 2507.

If the density is below 6.5 g/cm$^3$, the bonding strength between the hard particles and the base matrix becomes insufficient, wear resistance is further decreased, and desired wear resistance in a harsh environment such as an engine for fuel gas cannot be secured. From this point of view, the density is limited to be 6.5 g/cm$^3$ or higher. The density is preferably Furthermore, if the radial crushing strength is below 450 MPa, the bonding strength between the hard particles and the base matrix is decreased, and cracking, chipping or the like is likely to occur at the time of processing. The radial crushing strength is preferably 540 MPa or higher.

Next, a preferred method for producing the valve seat insert of the invention will be explained.

First, as a raw-material powder, a pure iron powder, a graphite powder as an alloy element powder, and one kind or two or more kinds selected from a Ni powder, a co powder, a Cr powder, a Mo powder, a V powder, and a W powder are blended so as to form the base matrix part composition described above, and a hard particle powder having the above-described composition further is blended into the resulting powder mixture at the content described above, or a solid lubricant particle powder is blended into the resulting powder mixture at the content (amount of dispersion) described above. Preferably, zinc stearate or the like as a lubricant is further blended into the resulting powder mixture. The mixture is mixed and kneaded to obtain a mixed powder. According cc the invention, the above-mentioned pure iron powder may be blended with a predetermined amount of the above-mentioned powders of alloy elements, the pure iron powder may be blended with a predetermined amount of a low alloy steel powder containing those alloy elements or an alloy iron powder containing chose alloy elements, or the alloy element powders may be blended using both of them in combination to form the base matrix part composition described above.

Next, it is preferable that this mixed powder is charged into a valve seat insert-shaped mold having a predetermined dimension, and is subjected to a compression molding-sintering (1P1S) of performing compression molding and then sintering to obtain a sintered body.

In case in which a valve seat insert having a double-layer structure is produced, raw-material powders for a valve contacting face side (a pure iron powder, an iron-base powder for an alloy steel powder, alloy element powders, a hard particle powder, and a solid lubricant particle powder) are blended and mixed at the above-described base matrix part composition, and thus a mixed powder for a valve contacting face side is obtained. Furthermore, raw-material powders for a supporting face side (a pure iron powder, an iron-base powder as an alloy steel powder, alloy element powders, and a solid lubricant particle powder) are blended and mixed at the above-described composition, and thus a mixed powder for a supporting face side is obtained. It is preferable that the mixed powder for the valve contacting face side and the mixed powder for the supporting face side thus obtained are sequentially charged into a mold so as produce a double-layer structure, and the powders are subjected to a compression molding-sintering process (1P1S) of performing compression molding and then sintering to obtain a sintered body.

Meanwhile, it is preferable to perform compression molding by press molding such as mechanical press, hydraulic press, or Servo press. Furthermore, it is preferable to perform sintering by a treatment of heating preferably to a temperature range of 1100° C. to 1200° C. in a reducing atmosphere or in a vacuum.

A process of repeating compression molding and sintering processes two times may also be employed. It is still acceptable to employ a forging-sintering process (FS) instead of the compression molding-sintering process.

The sintered body thus obtained is subjected to machining as necessary, and thus a valve seat insert as a final product is obtained.

Hereinafter, the invention will be explained in more detail by way of Examples.

EXAMPLES

An iron-base powder (a pure iron powder or an alley steel powder), alloy element powders, a solid lubricant particle powder, and a hard particle powder were blended at the composition of the amounts indicated in Table 1, and zinc stearate as a lubricant was blended thereinto in the amount indicated in Table 1. The mixture was mixed and kneaded with a V-type mixing machine, and thus a mixed powder was obtained. The blending amounts are indicated, in percentage (%) by mass with respect to the total amount of the iron-base powder, the alloy element powders, the hard particle powder and the solid lubricant particle powder. Furthermore, the blending amount of zinc stearate as a lubricant is indicated in parts by mass with respect to 100 parts by mass of the total amount of the iron-base powder, the alloy element powders, the hard particle powder and the solid lubricant particle powder. The composition, hardness and average particle size of the hard particles used are shown in Table 2. The average particle size of the hard particle powder was measured using a laser diffraction scattering analyzer.

TABLE 1

| | Raw-material powder blend | | | | | |
|---|---|---|---|---|---|---|
| Mixed powder No. | Iron-based powder Type*: blending amount (mass %) | Alloy element powders Type: blending amount (mass %) | Solid lubricant particle powder Type: blending amount (mass %) | Hard particle powder Type**: content (mass %) | Lubricant particl powder Type: blending amount (parts by mass)*** | Remarks |
| A | A: 64.0, B: 10.0 | C: 1.0, Co: 2.0, Ni: 1.0 | MnS: 2.0 | a: 20.0 | Zinc stearate: 1.0 | Comparative Example |
| B | A: 64.0, B: 10.0 | C: 1.0, Co: 2.0, Ni: 1.0 | MnS: 2.0 | b: 20.0 | Zinc stearate: 1.0 | Suitable Example |
| C | A: 64.0, B: 10.0 | C: 1.0, Co: 2.0, Ni: 1.0 | MnS: 2.0 | c: 20.0 | Zinc stearate: 1.0 | Suitable Example |
| D | A: 64.0, B: 10.0 | C: 1.0, Co: 2.0, Ni: 1.0 | MnS: 2.0 | d: 20.0 | Zinc stearate: 1.0 | Suitable Example |
| E | A: 64.0, B: 10.0 | C: 1.0, Co: 2.0, Ni: 1.0 | MnS: 2.0 | e: 20.0 | Zinc stearate: 1.0 | Suitable Example |

TABLE 1-continued

| Mixed powder No. | Raw-material powder blend: Iron-based powder Type*: blending amount (mass %) | Alloy element powders Type: blending amount (mass %) | Solid lubricant particle powder Type: blending amount (mass %) | Hard particle powder Type**: content (mass %) | Lubricant particl powder Type: blending amount (parts by mass)*** | Remarks |
|---|---|---|---|---|---|---|
| F | A: 63.5, B: 10.0 | C: 1.5, Co: 2.0, Ni: 1.0 | MnS: 2.0 | f: 20.0 | Zinc stearate: 1.0 | Suitable Example |
| G | A: 64.0, B: 10.0 | C: 1.0, Co: 2.0, Ni: 1.0 | MnS: 2.0 | g: 20.0 | Zinc stearate: 1.0 | Suitable Example |
| H | A: 64.0, B: 10.0 | C: 1.0, Co: 2.0, Ni: 1.0 | MnS: 2.0 | h: 20.0 | Zinc stearate: 1.0 | Suitable Example |
| I | A: 29.0, B: 10.0 | C: 1.0, Co: 2.0, Ni: 1.0 | MnS: 2.0 | d: 55.0 | Zinc stearate: 1.0 | Suitable Example |
| J | A: 66.0, B: 10.0 | C: 1.0, Co: 2.0, Ni: 1.0 | MnS: 2.0 | d: 20.0 | Zinc stearate: 1.0 | Suitable Example |
| K | A: 51.0, B: 10.0 | C: 1.0, Ni: 1.0 | — | a: 35.0 | Zinc stearate: 1.0 | Comparative Example |
| L | A: 51.0, B: 10.0 | C: 1.0, Ni: 1.0 | MnS: 2.0 | a: 20.0, b: 15.0 | Zinc stearate: 1.0 | Suitable Example |
| M | A: 51.0, B: 10.0 | C: 1.0, Ni: 1.0 | MnS: 2.0 | a: 20.0, c: 15.0 | Zinc stearate: 1.0 | Suitable Example |
| N | A: 51.0, B: 10.0 | C: 1.0, Ni: 1.0 | MnS: 2.0 | a: 20.0, d: 15.0 | Zinc stearate: 1.0 | Suitable Example |
| O | A: 51.0, B: 10.0 | C: 1.0, Ni: 1.0 | MnS: 2.0 | a: 20.0, e: 15.0 | Zinc stearate: 1.0 | Suitable Example |
| P | A: 50.6, B: 10.0 | C: 1.4, Ni: 1.0 | MnS: 2.0 | a: 20.0, f: 15.0 | Zinc stearate: 1.0 | Suitable Example |
| Q | A: 51.0, B: 10.0 | C: 1.0, Ni: 1.0 | MnS: 2.0 | a: 20.0, g: 15.0 | Zinc stearate: 1.0 | Suitable Example |
| R | A: 51.0, B: 10.0 | C: 1.0, Ni: 1.0 | MnS: 2.0 | a: 20.0, h: 15.0 | Zinc stearate: 1.0 | Suitable Example |
| S | A: 30.8, B: 10.0 | C: 1.2, Ni: 1.0 | MnS: 1.0 | a: 55.0 | Zinc stearate: 1.0 | Comparative Example |
| T | A: 32.0, B: 10.0 | C: 1.0, Ni: 1.0 | MnS: 1.0 | a: 35.0, d: 20.0 | Zinc stearate: 1.0 | Suitable Example |
| U | A: 31.7, B: 10.0 | C: 1.3, Ni: 1.0 | MnS: 1.0 | a: 35.0, f: 20.0 | Zinc stearate: 1.0 | Suitable Example |
| V | A: 32.0, B: 10.0 | C: 1.0, Ni: 1.0 | MnS: 1.0 | a: 35.0, b: 20.0 | Zinc stearate: 1.0 | Suitable Example |
| 1A | A: 98.0 | C: 1.0 | MnS: 1.0 | — | Zinc stearate: 1.0 | Suitable Example |

*A: Pure iron powder, B: High-speed tool steel powder

**See Table 2

***(Parts by mass with respect to 100 parts by mass of (iron-base powder + alloy element powders + solid lubricant particle powder + hard particle powder)

TABLE 2

| Hard particle No | Chemical components (mass %): Mo | Cr | Si | Mn | V | Other | Balance | Hardness HV0.1 | Average particle size (μm) | Remarks |
|---|---|---|---|---|---|---|---|---|---|---|
| a | 28.5 | 8.5 | 2.6 | | | | Co | 750 | 60.0 | Comparative Example |
| b | 28.5 | 8.5 | | | | | Co | 710 | 61.0 | Suitable Example |
| c | 36.0 | 8.5 | | | | | Co | 989 | 63.0 | Suitable Example |
| d | 40.0 | 8.5 | | | | | Co | 1140 | 59.0 | Suitable Example |
| e | 44.0 | 8.5 | | | | | Co | 1199 | 61.0 | Suitable Example |
| f | 40.0 | 8.5 | | | 12.0 | Fe: 3.0 | Co | 1398 | 62.0 | Suitable Example |
| g | 40.0 | 8.5 | | 12.0 | | | Co | 1109 | 61.0 | Suitable Example |
| h | 40.0 | 8.5 | | 18.0 | | | Co | 1125 | 63.0 | Suitable Example |

Subsequently, the mixed powder was charged into a mold, and a 1P1S process of compression molding using a mechanical pressing machine to obtain a valve seat insert-shaped green compact, and then sintering the green compact was performed. Thus, a valve seat insert-shaped sintered body was obtained. In another part of the experiment, a mixed powder for a valve contacting face side and a mixed powder for a supporting face side material were sequentially charged into a mold so as to form a double-layer structure composed of a valve contacting face side and a supporting face side, and a 1P1S process of performing compression molding and sintering was performed in a similar manner. Thus, a valve seat insert-shaped sintered body having a double-layer structure was obtained. Sintering was carried out by a treatment of heating at 1100° C. to 1200° C. in a reducing atmosphere. In still another part of the experiment, a 2P2S process of repeating compression molding and sintering two times was performed, and thus a sintered body was obtained. The base matrix phase composition, and the contents of the hard particles and the solid lubricant particles of the sintered bodies thus obtained are shown in Table 3.

The sintered bodies thus obtained were machined, and thus valve seat inserts (size: 30 mmϕ×18 mmϕ×6.5 mm) were produced.

For the valve seat inserts thus obtained, density and the radial crushing strength were measured, and also a single piece rig wear test was performed to evaluate wear resistance.

The density was measured using the Archimedean method. The radial crushing strength was determined according to the procedure of JIS Z 2507.

Figure 4:
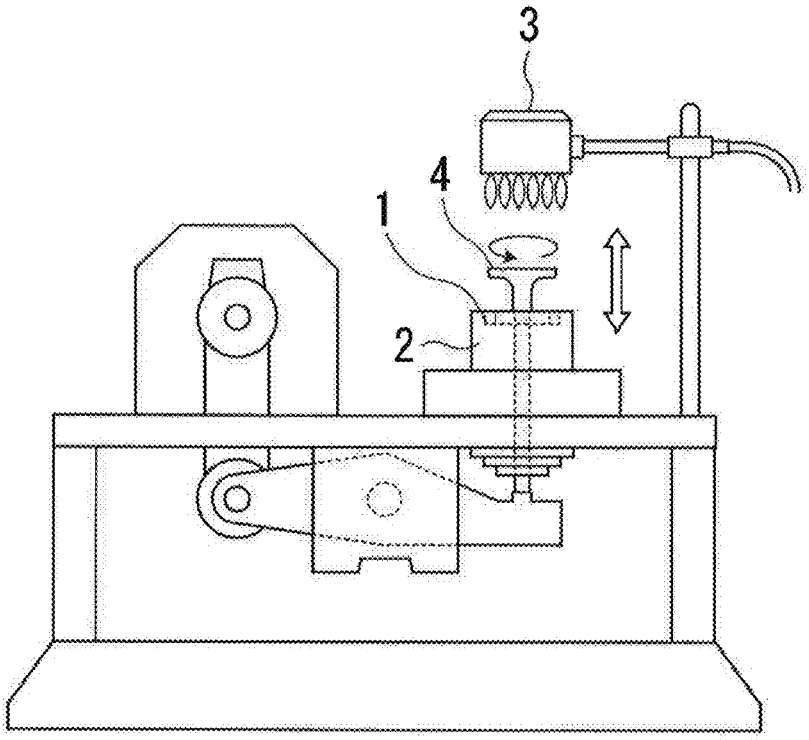
FIG. 4 is a schematic explanatory diagram for a single piece rig wear testing machine.

The single piece rig wear test was performed using a single piece rig wear testing machine as illustrated in FIG. 4. The amount of wear was measured as the amount of depression of the valve. The test conditions were as follows.

Testing temperature: 250° C.

Testing time: 4.5 hr

Frequency of cam rotation: 3000 rpm

Frequency of valve rotation: 20 rpm.

Spring load: 2960 N (upon setting)

Value material: T-400 padded

Lift amount 8.5 mm

The results thus obtained are shown in Table 4. Meanwhile, wear resistance was evaluated as the ratio of wear, which is the ratio of the amounts of wear of various valve: seat inserts with respect to the amount of wear of a reference material, obtained by taking a Comparative Example produced by the same production process, in which the total amount of hard particles was the same, and the amount of hard particles that did not contain Si was 0%, as a reference.

TABLE 3

| Valve seat insert No. | Mixed powder No. | Sintered body: Base matrix part composition (mass %) C | Ni | Co | Cr | Mo | V | W | Others | Total | Balance | Hard particles Ratio* (area %) | Content (mass %) | Solid lubricant particles Type: content (mass %) | Production method | Remarks |
|---|---|---|---|---|---|---|---|---|---|---|---|---|---|---|---|---|
| 1 | A | 1.1 | 1.0 | 14.1 | 2.1 | 6.2 | 0.2 | 0.2 | Si: 0.55, Mn: 1.2, S: 0.8 | 26.35 | Fe | 0 | 20.0 | MnS: 2.0 | 1P1S | Comparative Example |
| 2 | B | 1.1 | 1.0 | 14.6 | 2.1 | 6.2 | 0.2 | 0.2 | Si: 0.03, Mn: 1.2, S: 0.8 | 26.33 | Fe | 100 | 20.0 | MnS: 2.0 | 1P1S | Invention Example |
| 3 | C | 1.1 | 1.0 | 13.9 | 2.1 | 7.7 | 0.2 | 0.2 | Si: 0.03, Mn: 1.2, S: 0.8 | 27.13 | Fe | 100 | 20.0 | MnS: 2.0 | 1P1S | Invention Example |
| 4 | D | 1.1 | 1.0 | 12.3 | 2.1 | 8.5 | 0.2 | 0.2 | Si: 0.03, Mn: 1.2, S: 0.8 | 26.33 | Fe | 100 | 20.0 | MnS: 2.0 | 1P1S | Invention Example |
| 5 | E | 1.1 | 1.0 | 11.5 | 2.1 | 9.3 | 0.2 | 0.2 | Si: 0.03, Mn: 1.2, S: 0.8 | 26.33 | Fe | 100 | 20.0 | MnS: 2.0 | 1P1S | Invention Example |
| 6 | F | 1.6 | 1.0 | 9.3 | 2.1 | 8.5 | 0.2 | 0.2 | Si: 0.03, Mn: 1.2, S: 0.8 | 23.33 | Fe | 100 | 20.0 | MnS: 2.0 | 1P1S | Invention Example |
| 7 | G | 1.1 | 1.0 | 9.9 | 2.1 | 8.5 | 0.2 | 0.2 | Si: 0.03, Mn: 3.6, S: 0.8 | 26.33 | Fe | 100 | 20.0 | MnS: 2.0 | 1P1S | Invention Example |
| 8 | H | 1.1 | 1.0 | 8.7 | 2.1 | 8.5 | 0.2 | 0.2 | Si: 0.03, Mn: 4.8, S: 0.8 | 26.33 | Fe | 100 | 20.0 | MnS: 2.0 | 1P1S | Invention Example |
| 9 | I | 1.1 | 1.0 | 30.3 | 5.1 | 22.5 | 0.2 | 0.2 | Si: 0.03, Mn: 1.2, S: 0.8 | 61.33 | Fe | 100 | 55.0 | MnS: 2.0 | 1P1S | Invention Example |
| 10 | J | 1.1 | 1.0 | 12.3 | 2.1 | 8.5 | 0.2 | 0.2 | Si: 0.3 | 24.33 | Fe | 100 | 20.0 | — | 1P1S | Invention Example |
| 11 | K | 1.1 | 1.0 | 21.1 | 3.4 | 10.5 | 0.2 | 0.2 | Si: 0.94, Mn: 1.2, S: 0.9 | 39.34 | Fe | 0 | 35.0 | MnS: 2.0 | 2P2S | Comparative Example |
| 12 | L | 1.1 | 1.0 | 21.5 | 3.4 | 10.5 | 0.2 | 0.2 | Si: 0.55, Mn: 1.2, S: 0.8 | 39.35 | Fe | 42.8 | 35.0 | MnS: 2.0 | 2P2S | Invention Example |
| 13 | M | 1.1 | 1.0 | 21.0 | 3.4 | 11.6 | 0.2 | 0.2 | Si: 0.55, Mn: 1.2, S: 0.8 | 39.95 | Fe | 42.8 | 35.0 | MnS: 2.0 | 2P2S | Invention Example |
| 14 | N | 1.1 | 1.0 | 19.8 | 3.4 | 12.2 | 0.2 | 0.2 | Si: 0.55, Mn: 1.2, S: 0.8 | 39.35 | Fe | 42.8 | 35.0 | MnS: 2.0 | 2P2S | Invention Example |
| 15 | O | 1.1 | 1.0 | 19.2 | 3.4 | 12.8 | 0.2 | 0.2 | Si: 0.55, Mn: 1.2, S: 0.8 | 39.35 | Fe | 42.8 | 35.0 | MnS: 2.0 | 2P2S | Invention Example |
| 16 | P | 1.5 | 1.0 | 17.6 | 3.4 | 12.2 | 2.0 | 0.2 | Si: 0.55, Mn: 1.2, S: 0.8 | 38.95 | Fe | 42.8 | 35.0 | MnS: 2.0 | 2P2S | Invention Example |
| 17 | Q | 1.1 | 1.0 | 18.0 | 3.4 | 12.2 | 0.2 | 0.2 | Si: 0.55, Mn: 1.2, S: 0.8 | 37.55 | Fe | 42.8 | 35.0 | MnS: 2.0 | 2P2S | Invention Example |
| 18 | R | 1.1 | 1.0 | 17.1 | 3.4 | 12.2 | 0.2 | 0.2 | Si: 0.55, Mn: 1.2, S: 0.8 | 36.65 | Fe | 42.8 | 35.0 | MnS: 2.0 | 2P2S | Invention Example |
| 19 | S | 1.3 | 1.0 | 53.2 | 5.1 | 16.2 | 0.2 | 0.2 | Si: 1.46, Mn: 0.6, S: 0.4 | 58.36 | Fe | 0 | 55.0 | MnS: 1.0 | 2P2S | Comparative Example |
| 20 | T | 1.1 | 1.0 | 31.4 | 5.1 | 18.5 | 0.2 | 0.2 | Si: 0.94 Mn: 0.6, S: 0.4 | 58.34 | Fe | 36.4 | 55.0 | MnS: 1.0 | 2P2S | Invention Example |
| 21 | U | 1.4 | 1.0 | 28.4 | 5.1 | 18.5 | 2.5 | 0.2 | Si: 0.94 Mn: 0.6, S: 0.4 | 57.74 | Fe | 36.4 | 55.0 | MnS: 1.0 | 2P2S | Invention Example |
| 22 | V | 1.1 | 1.0 | 27.8 | 5.1 | 18.5 | 0.2 | 0.2 | Si: 0.94, Mn: 0.6, S: 0.4 | 54.74 | Fe | 36.4 | 55.0 | MnS: 1.0 | 2P2S | Invention Example |
| 23** | B | 1.1 | 1.0 | 14.6 | 2.1 | 6.2 | 0.2 | 0.2 | Si: 0.3, Mn: 1.2, S: 0.8 | 26.33 | Fe | 100 | 20.0 | MnS: 1.0 | 1P1S | Invention Example |
| | 1A | 1.0 | — | — | — | — | — | — | Mn: 0.6, S: 0.4 | 1.00 | Fe | — | — | MnS: 1.0 | | |

*[(Amount of hard particles that do not contain Si)/(total amount of hard particles)] × 100%
**Double-layer structure (upper valve contacting face side and lower supporting face side)

TABLE 4

| Valve seat insert No. | Test results: Density (g/cm$^3$) | Radial crushing strength (MPa) | Single piece rig wear test Ratio of wear* Valve seat insert | Remarks |
|---|---|---|---|---|
| 1 | 6.9 | 650 | 1.0 | Comparative Example |
| 2 | 7.0 | 652 | 0.8 | Invention Example |
| 3 | 6.9 | 639 | 0.6 | Invention Example |

TABLE 4-continued

| Valve seat insert No. | Test results: Density (g/cm$^3$) | Radial crushing strength (MPa) | Single piece rig wear test Ratio of wear* Valve seat insert | Remarks |
|---|---|---|---|---|
| 4 | 6.9 | 590 | 0.6 | Invention Example |
| 5 | 6.9 | 543 | 0.8 | Invention Example |
| 6 | 7.0 | 475 | 0.4 | Invention Example |
| 7 | 7.1 | 590 | 0.8 | Invention Example |

TABLE 4-continued

| Valve seat insert No. | Density ($g/cm^3$) | Radial crushing strength (MPa) | Single piece rig wear test Ratio of wear* Valve seat insert | Remarks |
|---|---|---|---|---|
| | Test results | | | |
| 8 | 7.1 | 588 | 0.8 | Invention Example |
| 9 | 7.0 | 452 | 0.5 | Invention Example |
| 10 | 7.1 | 595 | 0.9 | Invention Example |
| 11 | 7.0 | 667 | 1.0 | Comparative Example |
| 12 | 7.1 | 657 | 0.7 | Invention Example |
| 13 | 7.1 | 623 | 0.7 | Invention Example |
| 14 | 7.1 | 588 | 0.6 | Invention Example |
| 15 | 7.1 | 560 | 0.7 | Invention Example |
| 16 | 7.0 | 572 | 0.4 | Invention Example |
| 17 | 7.2 | 635 | 0.7 | Invention Example |
| 18 | 7.2 | 585 | 0.7 | Invention Example |
| 19 | 7.0 | 539 | 1.0 | Comparative Example |
| 20 | 7.0 | 490 | 0.8 | Invention Example |
| 21 | 7.0 | 451 | 0.8 | Invention Example |
| 22 | 7.1 | 480 | 0.4 | Invention Example |
| 23 | 7.0 | 660 | 0.8** | Invention Example |

*Amount of wear of the valve seat insert/amount of wear of reference valve seat inserts (No. 1, No. 11, No. 17)
**Ratio of wear with respect to valve seat insert No. 1

All of the Invention Examples had a density of 6.5 $g/cm^3$ or higher and a radial crushing strength of 450 MPa or higher, and in all of them, the amount of wear of the valve seat insert was small compared to the reference material, while enhanced wear resistance was obtained. On the other hand, in the Comparative Examples that were not within the range of the invention, the radial crushing strength was low, or wear resistance was deteriorated.

What is claimed is:

1. A valve seat insert for an internal combustion engine having excellent wear resistance, the valve seat insert being made of an iron-base sintered alloy in which hard particles are dispersed in a base matrix phase of an iron-base sintered alloy, wherein a base matrix part that includes the base matrix phase and the hard particles has a composition containing, in percentage (%) by mass, 0.5% to 2.0% of carbon (C) and 10% to 70% in total of one kind or two or more kinds selected from nickel (Ni), cobalt (Co), chromium (Cr), molybdenum (Mo), vanadium (V), tungsten (W), manganese (Mn), silicon (Si) and sulfur (S), with the balance being iron (Fe) and unavoidable impurities, the valve seat insert has a structure in which, as the hard particles, Co-base hard particles having a composition containing, in percentage (%) by mass, 1.0% or less of C, 25% to 50% of Mo, 5% to 15% of Cr, Si as an impurity in a content adjusted to be 0.3% or less, with the balance being Co, and having a Vickers hardness of 500 to 1,500 HV, are dispersed in an amount of 10% to 60% by mass with respect to the total amount of the valve seat insert, and the valve seat insert has a density of 6.5 $g/cm^3$ or higher and a radial crushing strength of 450 MPa or higher.

2. The valve seat insert for an internal combustion engine according to claim 1, wherein the hard particles are replaced with two or more kinds of hard particles, one kind of the hard particles are Co-base hard particles having a composition containing, in percentage (%) by mass, 1.0% or less of C, 25% to 50% of Mo, 5% to 15% of Cr, and Si as an impurity in a content adjusted to be 0.3% or less, with the balance being Co, and having a Vickers hardness of 500 to 1,500 HV, the amount of the Co-base hard particles is 10% or more by area with respect to the total amount of the hard particles, and the two or more kinds of hard particles are dispersed in an amount of 10% to 60% by mass with respect to the total amount of the valve seat insert.

3. The valve seat insert for an internal combustion engine according to claim 1, wherein the Co-base hard particles have a composition further containing, in percentage (%) by mass, one kind or two or more kinds selected from 35% or less of Mn, 20% or less of V, and 15% or less of Fe, in addition to the composition described above.

4. The valve seat insert for an internal combustion engine according to claim 1, wherein solid lubricant particles are further dispersed in the base matrix phase in an amount of 0.5% to 3.0% by mass with respect to the total amount of the valve seat insert, in addition to the hard particles.

5. A valve seat insert for an internal combustion engine having excellent wear resistance, the valve seat insert being made of an iron-base sintered alloy and having a double-layer structure in which a valve contacting face side and a supporting face side are integrally sintered, wherein the valve contacting face side is formed by dispersing hard particles in a base matrix phase of an iron-base sintered alloy, a base matrix part that includes the base matrix phase and the hard particles has a composition containing, in percentage (%) by mass, 0.5% to 2.0% of carbon (C) and 10% to 70% in total of one kind or two or more kinds selected from nickel (Ni), cobalt (Co), chromium (Cr), molybdenum (Mo), vanadium (V), tungsten (W), manganese (Mn), silicon (Si) and sulfur (S), with the balance being iron (Fe) and unavoidable impurities, the valve seat insert has a structure in which, as the hard particles, Co-base hard particles having a composition containing, in percentage (%) by mass, 1.0% or less of C, 25% to 50% of Mo, 5% to 15% of Cr, Si as an impurity in a content adjusted to be 0.3% or less, with the balance being Co, and having a Vickers hardness of 500 to 1,500 HV, are dispersed in an amount of 10% to 60% by mass with respect to the total amount of the valve contacting face side, and the supporting face side has a composition containing, in percentage (%) by mass with respect to the total amount of the supporting face side, 0.5% to 2.0% of C, or 70% or less in total of one kind or two or more kinds selected from Ni, Cr, Mo and copper (Cu), with the balance being Fe and unavoidable impurities.

6. The valve seat insert for an internal combustion engine according to claim 5, wherein the hard particles are replaced with two or more kinds of hard particles, one kind of the hard particles are Co-base hard particles having a composition containing, in percentage (%) by mass, 1.0% or less of C, 25% to 50% of Mo, 5% to 15% of Cr, and Si as an impurity in an amount adjusted to be 0.3% or less, with the balance being Co, and having a Vickers hardness of 500 to 1,500 HV, the amount of the Co-base hard particles is 10% or more by area with respect to the total amount of the hard particles, and the two or more kinds of hard particles are dispersed in an amount of 10% to 60% by mass with respect to the total amount of the valve contacting face side.

7. The valve seat insert for an internal combustion engine according to claim 5, wherein the Co-base hard particles have a composition further containing, in percentage (%) by mass, one kind or two or more kinds selected from 35% or less of Mn, 20% or less of V, and 15% or less of Fe, in addition to the composition described above.

8. The valve seat insert for an internal combustion engine according to claim 5, wherein solid lubricant particles are further dispersed in the base matrix phase in an amount of 0.5% to 3.0% by mass with respect to the total amount of the valve contacting face side, in addition to the hard particles.

9. The valve seat insert for an internal combustion engine according to claim 3, wherein solid lubricant particles are further dispersed in the base matrix phase in an amount of 0.5% to 3.0% by mass with respect to the total amount of the valve seat insert, in addition to the hard particles.

10. The valve seat insert for an internal combustion engine according to claim 7, wherein solid lubricant particles are further dispersed in the base matrix phase in an amount of 0.5% to 3.0% by mass with respect to the total amount of the valve contacting face side, in addition to the hard particles.

11. The valve seat insert for an internal combustion engine according to claim 2, wherein the Co-base hard particles have a composition further containing, in percentage (%) by mass, one kind or two or more kinds selected from 35% or less of Mn, 20% or less of V, and 15% or less of Fe, in addition to the composition described above.

12. The valve seat insert for an internal combustion engine according to claim 2, wherein solid lubricant particles are further dispersed in the base matrix phase in an amount of 0.5% to 3.0% by mass with respect to the total amount of the valve seat insert, in addition to the hard particles.

13. The valve seat insert for an internal combustion engine according to claim 6, wherein the Co-base hard particles have a composition further containing, in percentage (%) by mass, one kind or two or more kinds selected from 35% or less of Mn, 20% or less of V, and 15% or less of Fe, in addition to the composition described above.

14. The valve seat insert for an internal combustion engine according to claim 6, wherein solid lubricant particles are further dispersed in the base matrix phase in an amount of 0.5% to 3.0% by mass with respect to the total amount of the valve contacting face side, in addition to the hard particles.

* * * * *